United States Patent [19]

Fujisawa

[11] Patent Number: 4,883,222

[45] Date of Patent: Nov. 28, 1989

[54] OPENING STRUCTURE FOR PAPER BEVERAGE CONTAINERS

[76] Inventor: Satoko Fujisawa, Aptartment 401, 3-6-2 Tobakan, Meguro-ku, Tokyo, Japan

[21] Appl. No.: 317,550

[22] Filed: Mar. 1, 1989

[30] Foreign Application Priority Data

Apr. 4, 1988 [JP] Japan ..... 63-44799

[51] Int. Cl.[4] ..... B65D 5/74

[52] U.S. Cl. ..... 229/160.2; 206/631.3; 206/628

[58] Field of Search ..... 229/160.2, 125.42; 206/621.1, 621.2, 628, 631.3, 633, 616, 617

[56] References Cited

U.S. PATENT DOCUMENTS 3,520,464 7/1970 Pugh, Sr. ..... 206/631.3

4,821,950 4/1989 Sanchez et al. ..... 206/628

FOREIGN PATENT DOCUMENTS 2650092 5/1978 Fed. Rep. of Germany ..... 206/616

8203370 3/1981 PCT Int'l Appl. ..... 206/621.2

*Primary Examiner*—Gary Elkins

*Attorney, Agent, or Firm*—Richard M. Goldman; 10

[57] ABSTRACT

Disclosed is a beverage container that is formed of a resin or wax coated cardboard or paper, and has a body portion and a gabled top portion. The gabled top portion is adapted for initial sealing at a seal therein, and subsequent opening and reclosing and has a pair of edge walls and a leading edge adapted to form a reclosable dispenser spout. The gabled top further includes a tensile force tab adapted to the leading edge and adapted to pull the leading edge away the edge walls to break the seal therebetween and form the dispenser spout.

2 Claims, 2 Drawing Sheets

OPENING STRUCTURE FOR PAPER BEVERAGE CONTAINERS

FIELD OF THE INVENTIONS

The invention relates to wax and resin coated paper and cardboard beverage containers of the type normally having a square base, and a paralellepiped, rectangular body portion with a gabled top portion. The gabled top portion is adapted for initial sealing and subsequent unsealing to provide a closeable dispensing outlet. More particularly, the invention relates to structures for facilitating opening the gabled top portion.

BACKGROUND OF THE INVENTION

Resin and wax coated cardboard and paperboard cartons have been used for many years for the packaging, distribution and merchandising of beverages such as milk and fruit juices. The expressions "container" and "carton" characterized by a "gabled top with a central laminar rib across the top" and further characterized as being formed of for example "paper", "cardboard", "paperboard" and coated with "coat wax", "plastic" or "resin" is intended to refer to the containers of the type described, for example, in U.S. Pat. Nos. 2,750,095 (Reissue No. Re. 25021), 3,120,333, 3,120,335.

The gabeled top cartons described therein are formed of polymer coated paperboard, for example, polyethylyne paperboard. Typical containers are shown in U.S. Pat. No. 3,120,333 to Arthur J. Seiple for *Container With Infolded Bottom Closure,* and U.S. Pat. No. 3,458,110 to Alex K. Goldman for *Reclosable Container.* The individual cartons are formed from blanks of stiff, foldable, and resilient material such as paperboard coated on both sides with heat sealable thermal plastic material, for example, polyethylene. The coated blank is cut and squared to form a rectangular carton with a flat bottom and gabled top as shown, for example in U.S. Pat. No. 3,120,335 issued Feb. 4, 1964 to Harry B. Egleston, et al for *Container With Infolded Bottom Enclosure.* The blank is divided to three main portions including a top portion, a central portion, and a bottom portion. The central portion of the blank is comprised of a plurality of body panels between transverse fold lines which become the body of the carton when erected. The central portion includes a first side panel, a front panel, second side panel, and rear panel and first sealing flap. The bottom portion of the blank is comprised of bottom closure panels and a second sealing flap foldably connected to and integral with the lower ends of the panels and the flap along the fold line. The bottom panel is flanked by fold back flaps foldably connected along diagonal fold lines. Likewise, the bottom panel has fold-back flaps foldably connected to it along diagonal fold lines.

Details of the manufacture and assembly of gabled top cartons are described, for example, in U.S. Pat. No. 3,270,940 issued Sept. 6, 1966, U.S. Pat. No. 3,120,333 issued Feb. 4, 1964, U.S. Pat. No. 3,120,335 issued Feb. 4, 1964, and U.S. Pat. No. 4,568,018 issued Feb. 4, 1986, all of which are specifically incorporated herein by reference.

A conventional one quart milk container has a height of about 7½ inches, a base of 2¾ inch square, and the gable extends about one inch beyond the top of rectangular side. The central rib of the gable top extends an additional one-half inch upward.

While these containers are referred to as "wax", "cardboard", "paperboard" and the like, these packing containers, i.e., cartons of the nonreturnable type for the packing of milk, juices, and the like, are generally manufactured from flexible laminated material which comprises a carrier layer of paper coated on both sides with thin layers of a liquid type heat sealable plastic material, for example, polyethelyne. Petroleum waxes have been used as a protective coating for various types of beverage containers and cartons for a long time. The coating serves a purpose of protecting the container where the paper from direct contact with the food or dairy product, food, beverage, or dairy product contained therein. This is particularly necessary with milk cartons where it is necessary to preserve the rigidity of the container and retain its usefulness and sales appeal. Improvements have been made by incorporating certain additives into the petroleum wax to improve flexibility, toughness, and peel resistance. Among some of the additives have been proposed and utilized are polyethylene, and copolymers of ethylene with vinyl acid, and copolymers of ethylene with polyacetate. Still others have been with a copolymer of ethylene and vinyl acetate. Still other container coatings are compositions of paraffin wax, ethylene-vinyl acid copolymers, and Fisher-Tropsch reaction products.

Typical beverage cartons or containers of the prior art are shown in FIGS. 9, 10, and 11. These cartons, which are referred to herein as "beverage cartons" are customarily rectilinear in form, for example, with a square base 1 and a rectangular parallelepiped body portion 5 with a gabled top portion 7. The gabled top portion 7 is characterized by a central laminar rib 9. The gable top portion 7 has inwardly coverging side walls 10*a* and 10*b*, and end walls 14*a* and 14*b*. Each end wall has a trinangular portion 114*a*, folded portions 114*b* and 114*c*, and a leading edge 15. The leading edge 15 is the upward extension of the folded portions 114*b* and 114*c*, with a vertical fold line l15*v* defining the point or apex of the outlet spout or dispenser 17, and a pair of horizontal fold lines separating the leading edge end wall portions 14*a* and 14*b*.

These cartons 1 are typically opened by pulling apart sides 11 and 13 of the gabled top portion 7 and pulling forward a leading edge 15, e.g., a foreshortened leading edge 15, to form a pouring spout or dispensing spout therein 17. The dispensing spout 17 is closed by pressing the leading edge 15 and side portions 114*b*, 114*c* thereof back against the spread sides 11 and 13 and pushing the spread sides 11 and 13 together, back to the closed position.

One problem common to the beverage carton 1 of the prior art is the absolute necessity of initially providing an air, liquid, and microbe tight seal between the sides 11 and 13 and the leading edge 15, i.e., between the sides 11, 13, and the upward extension of the folded portions 114*b*, 114*c*, of the end wall. This is especially necessary in the case of foodstuffs in order to maintain the cleanliness and purity of the contents of the carton 1. However, the air and liquid tight seal between the spout sides 11 and 13 and the spout leading edge 15, while solving one problem, gives rise to another serious problem for the consumer.

This is because the spout sides 11 and 13 and the spout leading edge 15 extensions of the end wall 14, which together comprise the dispensing spout or outlet 17, must be sealed together in order to avoid leakage, weeping, or contamination The adhesive forming the seal between the spout sides 11, 15, and the leading edge 15 has a yield strength approaching that of the coated paper or cardboard. Opening a beverage container is a complex ergonomic exercise, requiring simultaneous spreading of the side walls, 11, 13, tearing the leading edge 15 from the spread side walls 11, 13, and deforming the leading edge 15 to form the spout 17. As a result, the leading edge 15 and spout 17 may be easily torn or damaged on openingby the consumer. This results in a spout that pours erratically and that may not even be capable of being reclosed. In fact, for young children and the elderly, two classes of consumers lacking manual dexterity, it almost impossible to properly open typical beverage cartons of the prior art without doing damage to one or more of the sidewalls 11 and 13 or the leading edge 15 of the dispensing spout 17. Once the dispensing spout 17, and generally the leading edge 15 thereof, is torn, the liquid contents such as either milk or juice, can be spilled all over the table from the damaged parts of the spout 17. U.S. Pat. No. 3,520,464 to W. A. Pugh for *Lift And Pull Ring Container* discloses one possible solution to the problem, the provision of a pull ring on the triangular portion 114*a* of the end wall 14. U.S. Pat. No. 3,450,328 to Willis R. Barrett for *Pull Tab For Gable Top Container* describes a tape-like pull tab overlying the lip 15, and the lower portions, i.e., the triangular portion 114*a*, and the folded portions 114*b* and 114*c* of the end wall 14. However, neither of these proposed solutions have attained commercial acceptance. Therefore, a need still exists to allow the very young, the elderly, and those otherwise lacking manual dexterity to readily open paper beverage cartons.

SUMMARY OF THE INVENTION

The invention provides a tensile force tab means adherent to the surface of the leading edge 15 (i.e., the upward extension of the folded portions 114*b*, 114*c*, above the fold line 115) of the dispenser spout 17 in order to utilize a simple linear pulling motion rather than the more complex set of substantially simultaneous spreading, tearing, and deforming motions to separate the leading edge 15 from the sidewalls 11 and 13 to thereby formed the dispensing outlet or spout 17. This enables the consumer to more easily open the carton 1, and avoid damaging the spout 17.

The tensile force means, adherent above the fold lines 15, may be a paper tap as a reinforced paper tab, a loop of string or other threaded or filamentary material, for example, with both ends adherent to the leading edge 15 of the opening. The tensile force means may be folded within the leading edge 15 of the spout 17 when the spout 17 is closed. The tensile force means can be either attached to the leading edge or formed by an extension of the leading edge 15, and is above the horizontal fold line 115*h*. The material of the tensile force means, which may be a tab, flap, or filamentary means of string, can be paper, plastic, or other material compatible with the intended use, and is adherent to the leading edge 15 of the spount above the triangular portion 114*a* of the end walls 14, e.g., by position or choice of adhesive or bonding agent, in a way that avoids parting of the tab-leading edge seal before parting of the leading edge-side wall seal.

THE FIGURES

The invention described and claimed herein may be understood by reference to the Figures appended hereto.

Figure 5:
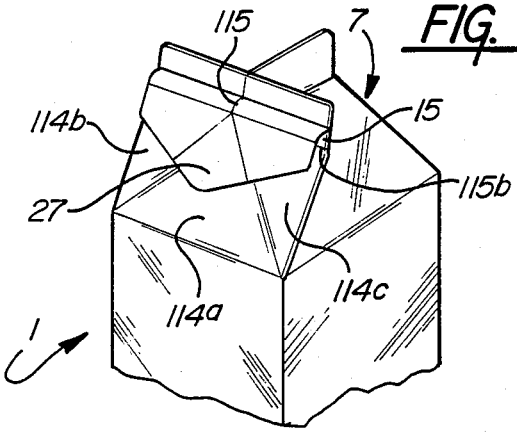

FIG. 5 shows an embodiment where the tensile force means extends outwardly from the sealed surface of the leading edge flab, is pentagonal, and is capable of being folded between the sidewalls 11, and 13 of the dispenser spout 17 when the dispenser spout 17 is closed.

Figure 6:
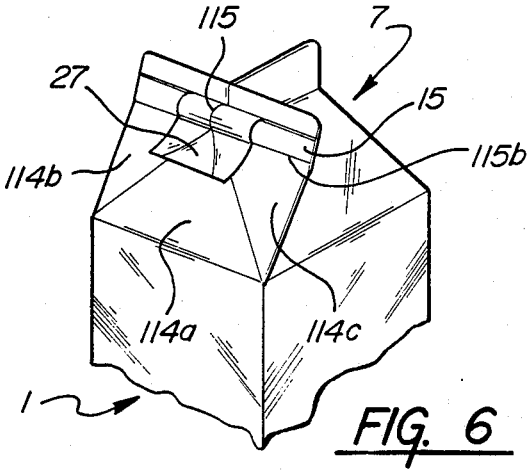

FIG. 6 shows an alternative embodiment of the exemplification shown in FIG. 5 where the tensile force means is smaller, extending only across the portion of the leading edge at the dispenser spout.

Figure 7:
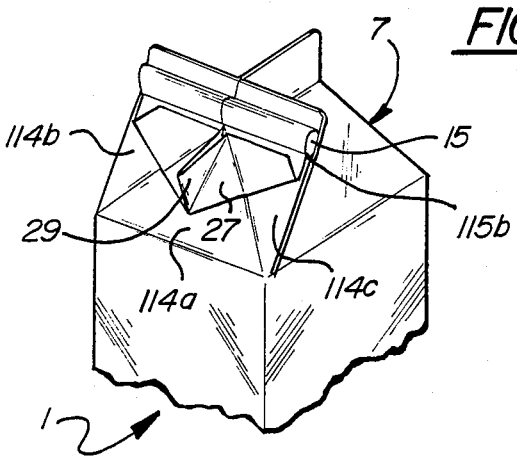

FIG. 7 is an embodiment of the tensile force means shown in FIGS. 5 and 6 where the tensile force means has a pulled tab folded therein.

Figure 8:
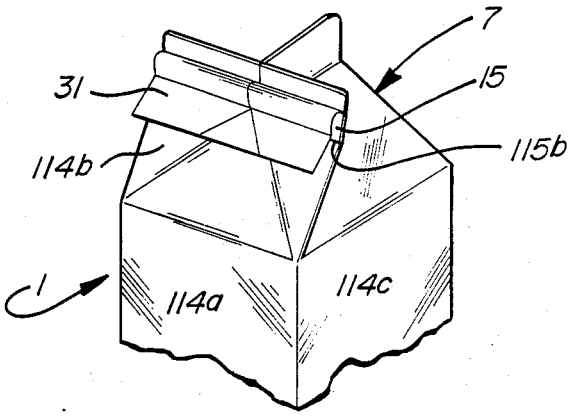

FIG. 8 is a further embodiment of the tab means shown in FIGS. 5 and 6, extending all the way across the leading edge but only part way down the leading edge.

Figure 9:
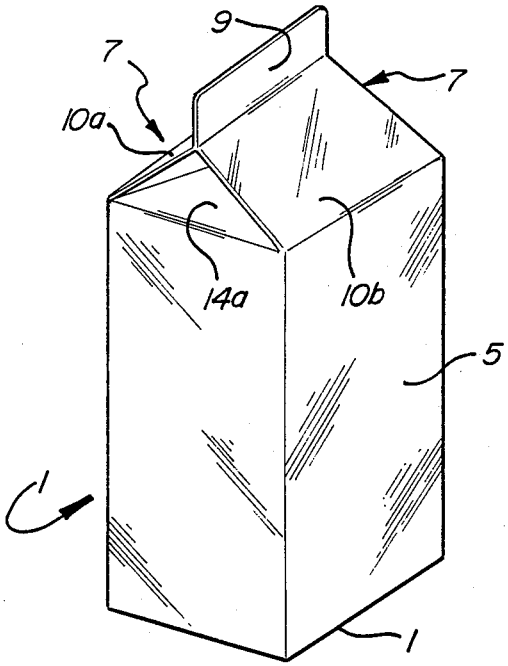
FIG. 9 PRIOR ART
Figure 10:
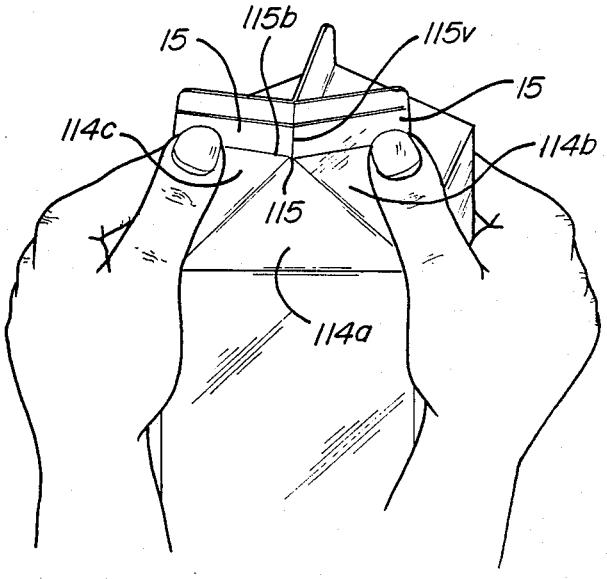
FIG. 10 PRIOR ART
Figure 11:
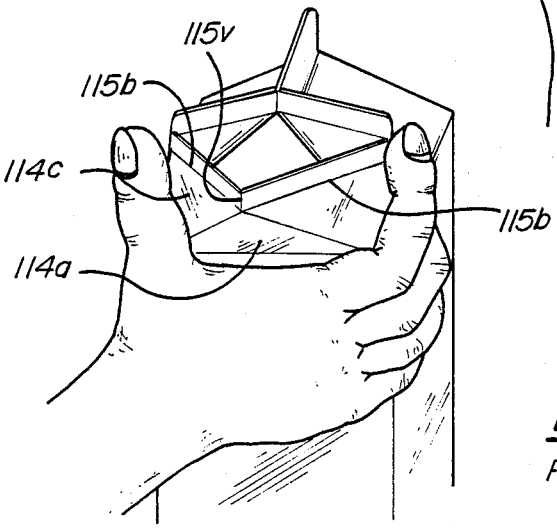
FIG. 11 PRIOR ART

FIGS. 9, 10 and 11 are examplary of the prior art.

FIG. 9 shows a beverage carton of the prior art while FIGS. 10 and 11 show the means for opening thereof.

DETAILED DESCRIPTION OF THE INVENTION

Figure 1:
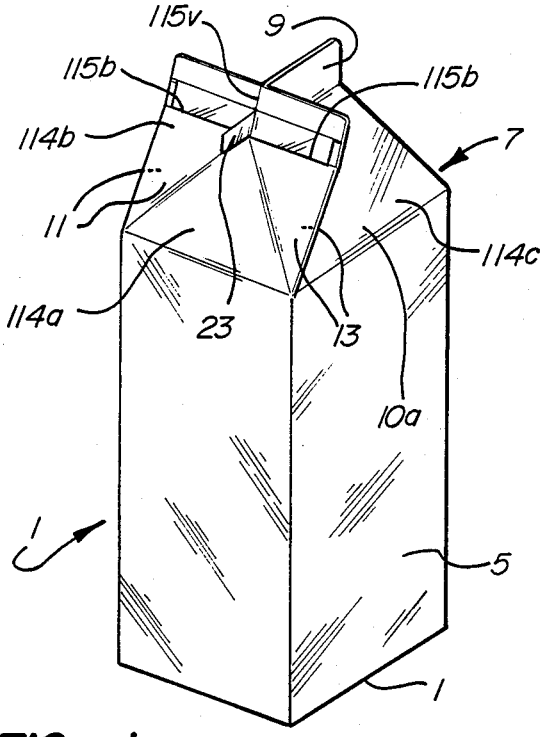
FIG. 1 is a perspective view of one exemplification of the invention showing a pull tab adherent to the leading edge of the dispensing spout.

FIG. 1 is an isometric view of an embodiment of the invention where the tensile force tab means is a flap or tab with an extending portion 23 provided on the surface of the leading edge 15 of the dispenser spout 17 above the horizontal fold line 115*h*. The flap 23 may be folded between the sides 11 and 13 of the dispenser spout 17 when the dispenser spout is closed. To form the spout 17, the sides 11 and 13 of the gabled top portion 7 are pulled apart to expose the surface of the leading edge 15 of the spout 17. Thereafter, the paper flap or tab 23 is pulled directly outward from the leading edge 15 and toward the user. This serves to pull apart the end wall 14*a* from the side walls 10*a* and 10*b*. In this way, it possible to separate the end wall 14*a* from the side walls 10*a* and 10*b* and form the dispensing spout 17 from the sidewalls 11 and 13 thereof without the normal squeezing and pulling motion heretofore necessary.

Figure 2:
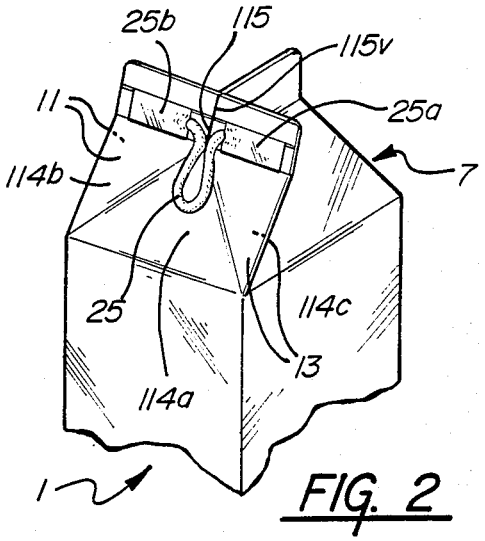
FIG. 2 shows an alternative examplification where the tensile force means is a string attached to two halves of the leading edge surface.

FIG. 2 shows an alternative examplification of the invention where a loop of string or other filamentary material 25 has the ends 25*a*, 25*b* thereof affixed against the surface of the leading edge 15 of the spout above the horizontal fold line 115*h*. As before, to form the spout 17, the sides 11 and 13 of the gabled top portion 7 are pulled apart to expose the surface of the leading edge 15 of the dispensing spout 17 and the tab or other filamentary tensile force means 25 is pulled away from the leading edge 15 toward the user to pull apart the pasted and pressed surface of the leading edge 15 of the spout 17 from the spread-out sidewalls 11 and 13 of the gabled top 7, i.e., to separate the end wall portion 114*b* and 114*c* from the side walls 10*a*, 10*b*.

Figure 3:
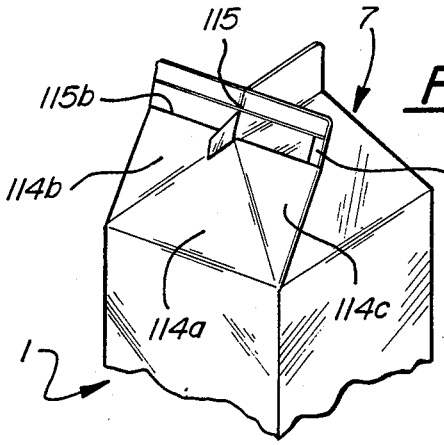
FIG. 3 is perspective view of a further embodiment where the tensile force means is a tab adherent to one-half of the leading edge.

FIG. 3 shows a still further embodiment of the invention as illustrated in FIG. 1 where the tab 23 extending outwardly from the leading edge 15 is attached to only one side of the leading edge 15 of the spout 17 and not both sides.

Figure 4:
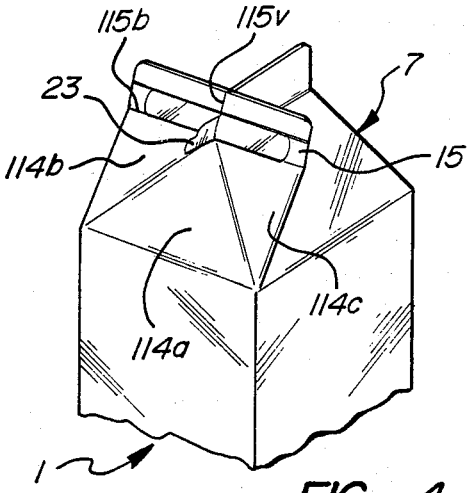
FIG. 4 shows an alternative exemplification of the embodiment shown in FIG. 1. In the exemplification shown in FIG. 4 the tab is contoured.

FIG. 4 shows a further alternative examplification of the invention as illustrated in FIG. 1 where the outwardly extending portion of the tab 23 is partially cut away. Operation is the same as described for the embodiment shown in FIG. 1.

FIG. 5 shows a further embodiment of the invention where the tensile force means, i.e., tab 27, is adherent to the interior surface of the leading edge 15 of the dispensing spout 17 and extends outwardly over the top thereof. That is, the tab 27, is a laminate between and end wall 14 and a pair of sidewalls 10*a* and 10*b*. In the exemplification shown in FIG. 5, the flap 27 is in the form of a pentagon. The tab 27 has creases as shown in the drawing. These creases allow the tab 27 to conform to the shape of the closed gabled top 7 and to be folded inside the closed gabled top between the sidewalls 11 and 13 thereof. The process of opening is as described above, that is the sidewalls 11 and 13 of the gabled top are pulled apart and then the tab 27 is grabbed and pulled forward away from the container 1 toward the user. Ever, in the exemplification shown in FIG. 5 it should be noted that the tab 27 is to be folded down across the front of the leading edge 15 upon reclosing in order not to contaminate the contents while pouring.

FIGS. 6, 7 and 8 are alternative exemplifications of the structure shown in FIG. 5. In FIG. 6, the flap is extends only part of the way across the dispensing spout 17, and is shown as a square tab 27 at the center of the edge. While FIG. 7 shows a further examplification having a shape similar to that shown in FIG. 5 but with a projection 29 on the tab 27. In this case, it is possible to pull either the whole flap 27 or the projection 29 to separate the sealed leading edge 15 from the sidewalls 11 and 13 and form dispensing spout 17.

FIG. 8 shows the rectangular flap 31 that is an extension of the end wall 14.

While the invention has been described with respect to certain preferred exemplifications and embodiments thereof, it is not intended to limit the scope of the invention thereby but solely by the claims appended hereto.

I claim:

1. A beverage container formed of resin or wax coated cardboard or paper, having a reclosable dispensing spout for dispensing beverage therefrom, and comprising, in combination:

(a) a rectangular, parallel body portion having a gable top (7) with a lateral rib across the top thereof, said gable top having endwalls (14*a*) and sidewalls (10*a* and 10*b*), one of said endwalls (14*a*) of said gable top being adapted for initial sealing said spout at a seal therein and subsequent opening and reclosing said spout, said one end wall (14*a*) having a pair of folded portions (114*b* and 114*c*) and a triangular port at a horizontal edge line (115*h*), with a leading edge (15) defining a free e above said horizontal edge line (115*h*); and (b) paper vertical tab tensile force means (23) adherent to an external of the leading edge (15) of the reclosable dispensing spout at the said lead and extending horizontally outwardly from said leading edge (15) said tensile means (23) being adapted to be pulled away from the beverage container (1) t the leading edge (15) from the sidewalls (10*a* and 10*b*) and open the reclosable dispensing spout.

2. A beverage container formed of resin or wax coated cardboard or paper, having a reclosable dispensing spout for dispensing beverage therefrom, and comprising, in combination:

(a) a rectangular, parallel body portion having a gable top (7) with a central lateral rib across the tip thereof, said gable top having endwalls (14*a*) and sidewalls (10*a* and 10*b*), one of said endwalls (14*a*) of said gable top being adapted for initial sealing said spout at a seal therein and subsequent opening and reclosing said spout, said one end wall (14*a*) having a pair of folded portions (114*b* and 114*c*) and a triangular portion terminating at a horizontal edge line (115*h*), with a leading edge (15) defining a free edge of the spout above said horizontal edge line (115*h*); and (b) pentagonal tensile force tab means (27) adherent to an interior surface of the leading edge (15) and the sidewalls (10*a* and 10*b*) of the reclosable dispensing spout and extending over substantially the entire distance of the tip of said leading edge (15), said tensile force tab means (27) being laminated between the folded portions (114*b* and 114*c*) of the end wall (14*a*) and the sidewalls (10*a* and 10*b*), said tensile force tab means (27) being creased and conforming to the gable top (7) between the sidewalls (11 and 13) thereof, said pentagonal tensile force tab means (27) being adapted to be pulled away from the beverage container (1) to separate the leading edge (15) from the sidewalls (10*a* and 10*b*) and open the reclosable beverage dispensing spout.

* * * * *